United States Patent [19]

Sugiura

[11] Patent Number: 5,060,927

[45] Date of Patent: Oct. 29, 1991

[54] SHEET FEEDING DEVICE

[75] Inventor: Toshiaki Sugiura, Hekinan, Japan

[73] Assignee: Brother Kogyo Kabushiki Kaisha, Aichi, Japan

[21] Appl. No.: 478,141

[22] Filed: Feb. 9, 1990

Related U.S. Application Data

[63] Continuation of Ser. No. 404,904, Sep. 8, 1989, abandoned.

[30] Foreign Application Priority Data

Feb. 14, 1989 [JP] Japan ..... 1-16060[U]

[51] Int. Cl.[5] ..... B65H 3/06

[52] U.S. Cl. ..... 271/117; 271/109

[58] Field of Search ..... 271/109, 117, 127, 171

[56] References Cited

U.S. PATENT DOCUMENTS

| | | | |
|---|---|---|---|
| 4,098,501 | 7/1978 | Tani et al. | 271/117 |
| 4,189,138 | 2/1980 | Kaneko et al. | 271/109 |
| 4,351,519 | 9/1982 | Jendrick | 271/117 |
| 4,998,714 | 3/1991 | Sparer et al. | 271/117 |

FOREIGN PATENT DOCUMENTS

| | | | |
|---|---|---|---|
| 26977 | 4/1981 | European Pat. Off. . | |
| 113534 | 10/1978 | Japan | 271/117 |
| 3236 | 1/1981 | Japan . | |
| 47734 | 3/1983 | Japan | 271/117 |
| 113045 | 7/1983 | Japan | 271/117 |
| 212334 | 12/1984 | Japan | 271/109 |
| 19627 | 1/1985 | Japan . | |
| 19628 | 1/1985 | Japan | 271/109 |
| 27344 | 2/1988 | Japan . | |
| 2187716 | 9/1987 | United Kingdom . | |

*Primary Examiner*—Robert P. Olszewski
*Assistant Examiner*—Steve Rein
*Attorney, Agent, or Firm*—Kane, Dalsimer, Sullivan, Kurucz, Levy, Eisele and Richard

[57] ABSTRACT

In a sheet feeding device adapted to be positioned in a main unit such as a copying machine, a printer and the like, having a case member for holding a plurality of cut-form sheets in a stacked state and a pair of feeding rollers for feeding the sheet one by one, an indicator for indicating a size of the stacked sheet and an interval change mechanism for automatically changing an interval between the pair of feeding rollers in accordance with the size indicated by the indicator when the sheet feeding device is positioned in the main unit, are provided. Thus, according to the size of the stacked sheet, the pair of sheet feeding rollers are respectively placed at the most suitable positions for a sheet feeding operation.

4 Claims, 4 Drawing Sheets

SHEET FEEDING DEVICE

CONTINUING DATA

This application is a continuation-in-part (i.e., 10*a* C-I-P) of abandoned U.S. patent application Ser. No. 404,904 filed on Sept. 8, 1989 in the names of Toshiaki SUGIURA, Sigeo ISHIKAWA, Hiroshi TOKUDA, and Hikaru KAGA; and said U.S. patent application Ser. No. 404,904 is expressly incorporated by reference in its entirely herein.

BACKGROUND OF THE INVENTION

The present invention relates to a sheet feeding device for feeding a sheet, having a sheet cassette mounted in a machine main unit such as a copying machine.

Conventionally, this type of sheet feeding device has provided a sheet cassette, for holding a plurality of sheets in a stacked state, attachably and detachably mounted on the machine main unit. For example, depending on a sheet size, such as B4 and A4, a plurality of sheet cassettes corresponding to each of sizes are provided. When necessary, the sheet feed cassette is replaced with the another one. On the other hand, in the machine main unit, a shaft which is extended in a width direction of the sheets stacked in the sheet cassette and a sheet feeding roller which is driven to be rotated by the shaft are disposed. By the sheet feeding roller, sheet is fed one by one from the sheet cassette to the machine main unit.

To securely separate cut-form sheet one-by-one and satisfactorily feed it, the sheet feeding roller should be contacted with the sheet to be fed with a predetermined positional relationship in the width direction and should be rotated. However, when the sheet size is changed, because the sheet feeding roller position against the sheet is changed, a trouble may occur in feeding the sheet. As the countermeasures, thus far, various technologies where the position of the sheet feeding roller is changed according to the sheet size have been proposed.

For example, in the above technology which has been disclosed in Japanese Patent Provisional Publication SHO 60-19627, a sheet cassette is mounted in a direction perpendicular to the sheet feeding direction along a shaft which pivotally supports a sheet feeding roller, the sheet feeding roller being moved by the motion thereof. In the technology which has been disclosed in Japanese Utility Model Provisional Publication SHO 62-150439, a triangle plate is mounted on a sheet feeding roller, the triangle plate being moved when the feed cassette is mounted, thereby leftwardly and rightwardly moving the sheet feeding roller.

However, in the former type sheet feeding device, since the sheet cassette should be mounted in the direction perpendicular to the sheet feeding direction, the shape of the entire machine is restricted, resulting in a problem in designing other sections of the machine. On the other hand, in the latter type of sheet feeding device, as the sheet size increases, the triangle plate is remarkably extended, resulting in a problem where the entire machine size increases.

SUMMARY OF THE INVENTION

It is therefore an object of the invention to provide an improved sheet feeding device having a function capable of changing a positional relationship between the sheet feeding roller and the sheet size to be fed with a simple structure.

For this purpose, according to the present invention, there is provided a sheet feeding device comprising:

a case member for holding a plurality of sheets therein in a stacked state;

a pair of feed roller members for feeding said sheets one by one from said case member, the interval between said feed roller members being variable;

a type indicator provided on said case member, the length of said indicator representing the type of the sheets to be held in said case member; and interval change means for changing the interval between said pair of feed roller members depending upon the length of said indicator, whereby said interval is appropriated for the sheets to be fed by said pair of feed roller members.

DESCRIPTION OF THE ACCOMPANYING DRAWINGS

DESCRIPTION OF THE EMBODIMENTS

Figure 1:
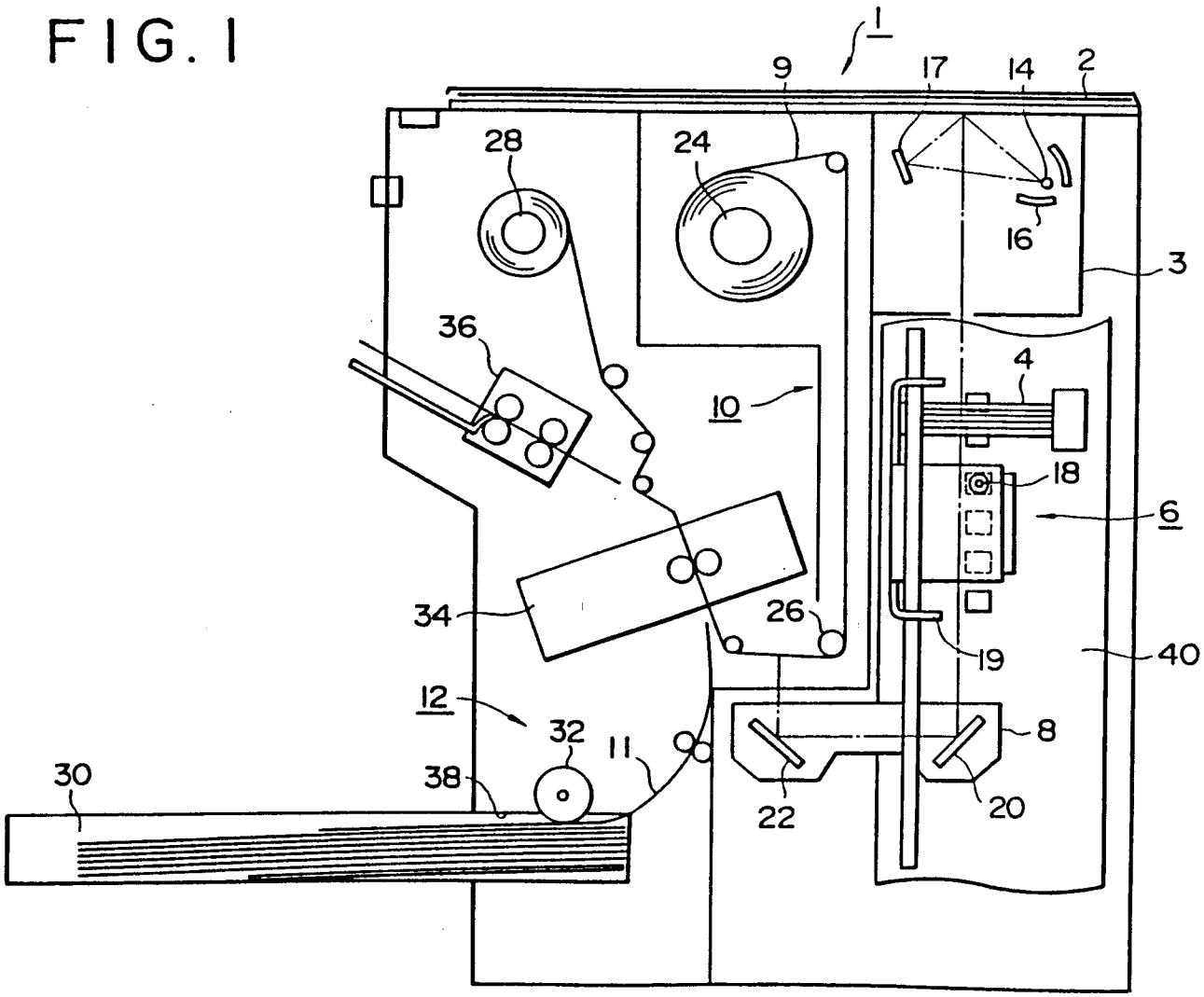
FIG. 1 is an outlined structural view showing an entire copying machine incorporating a sheet feeding device according to the present invention.

Referring to the drawings, an embodiment of a sheet feeding device according to the present invention is described hereinafter.

A copying machine 1 in this embodiment incorporating a sheet feeding device according to the present invention can make copies in a plurality of colors. As shown in FIG. 1, the copying machine 1 is chiefly provided with a light source unit 3 for illuminating an original subject 2, a filter unit 4 for changing light penetrability, a lens unit 6 for focusing an image on the original subject 2, a mirror unit 8 for forming an optical path of the light reflected by the original subject 2, a capsule sheet unit 10 for storing and feeding micro-capsule sheet 9, and a sheet feeding device 12 for storing and feeding a developing sheet 11.

The light source unit 3 is provided with a light source 14, a reflection plate 16, and a mirror 17. The filter unit 4 serves to change the penetrability of light reflected by the original subject 2 and to adjust the color tone of an copying image.

The lens unit 6 is chiefly structured by a lens holder 19 which mounts a lens, not shown, a positioning pin 18, and so forth, the lens unit 6 being designed to be vertically moved.

The mirror unit 8 is provided with two mirrors 20 and 22. The capsule-sheet unit 10 is structured by a cartridge shaft 24, a feed roller 26, a take-up shaft 28, etc. for feeding the micro-capsule sheet 9.

The sheet feeding device 12 is structured by a sheet cassette 30 for storing the developing sheet 11, a sheet feeding roller section 32 for feeding the developing sheet 11, etc.

Both the sheets, i.e., the micro-capsule sheet 9 and the developing sheet 11 which have been contacted are sent to a pressure developing unit 34 and they are pressurized in an overlapped state. The developing sheet 11 is sent to a heat fixing unit 36 and a copying image is fixed thereon.

The sheet feeding device 12 arranges the sheet 11 at the center of the sheet cassette 30. At a cassette attachment port 38, as shown in FIGS. 2A and 2D, and FIG. 3, disposed are, a shaft 40 which rotatably drives the left and right sheet feeding rollers 32*a* and 32*b* in a direction of an arrow mark A which pass through the left and right paper feed rollers 32*a* and 32*b* and a guide shaft 42 which is disposed in parallel with the shaft 40.

The shaft 40 has a groove 44 in the longitudinal direction. The sheet feeding roller 32*a*, 32*b* are engaged with the groove 44 and thereby the sheet feeding rollers 32*a*, 32*b* are respectively rotated along with the shaft 40 and are reciprocally movable. At the center of the shaft 40, stoppers 46*a* and 46*b* for regulating the movement of the sheet feeding rollers 32*a*, 32*b* are provided. When the sheet cassette 30 is not attached to the cassette attachment port 38, the shaft 40 and the sheet feeding rollers 32*a*, 32*b* are placed above the cassette attachment port 38 as to smoothen the insertion of the sheet cassette 30. When the sheet cassette 30 is completely attached to the cassette attachment port 38, the shaft 40 and the sheet feeding rollers 32*a*, 32*b* are lowered by a well-known lift-down mechanism, not shown, thereby contacting the sheet feeding rollers 32*a*, 32*b* with the sheet 11. Thus, the sheet feeding rollers 32*a*, 32*b* are not contacted with the paper 11 until the rollers move to a proper position in the axial direction of the shaft 40 according to the sheet size by a mechanism described later. The guide shaft 42 is provided with a pair of guide screw sections 48*a* and 48*b* whose thread direction is reverse each other. The guide screw section 48 is screwed to roller movement sections 50*a* and 50*b*. The roller movement section 50 is provided with tube sections 51*a* and 52*b*, screwed to the guide screw section 48, and arm sections 52*a*, 52*b*, 53*a*, and 53*b*, extended from both the ends of the tube sections 51*a* and 51*b* to the shaft 40. The outer ones of the arm sections 52*a* to 53*b* are in the shape of letter "Y", i.e., a yoke portion is formed, and thereby pinching the shaft 40.

Figure 4:
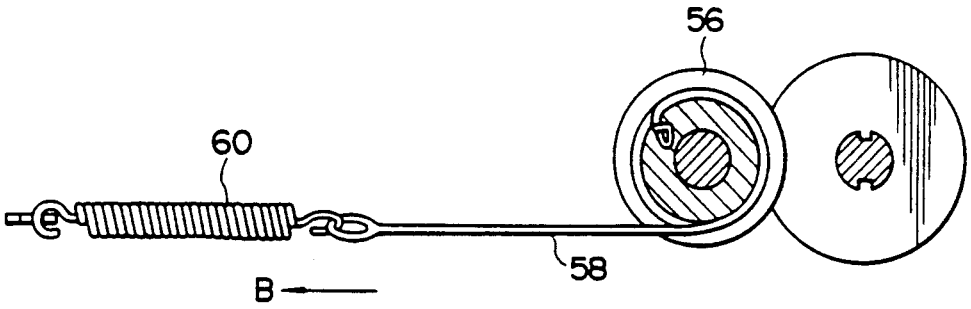
FIG. 4 is a descriptive view showing a function of a pulley provided on the sheet feeding device according to the present invention.

The guide shaft 42 is provided with a pinion gear 54 for driving thereof, the gear 54 being disposed on the outside of the guide screw section 48*b*. In addition, a pulley 56 is secured on the outside of a frame 55 of the copying machine 1. As shown in FIG. 4, a wire 58 is wound around the pulley 56. One end of the wire 58 is connected to an elastic spring 60 which is always tensioned in a direction of an arrow mark B.

Figure 2A:
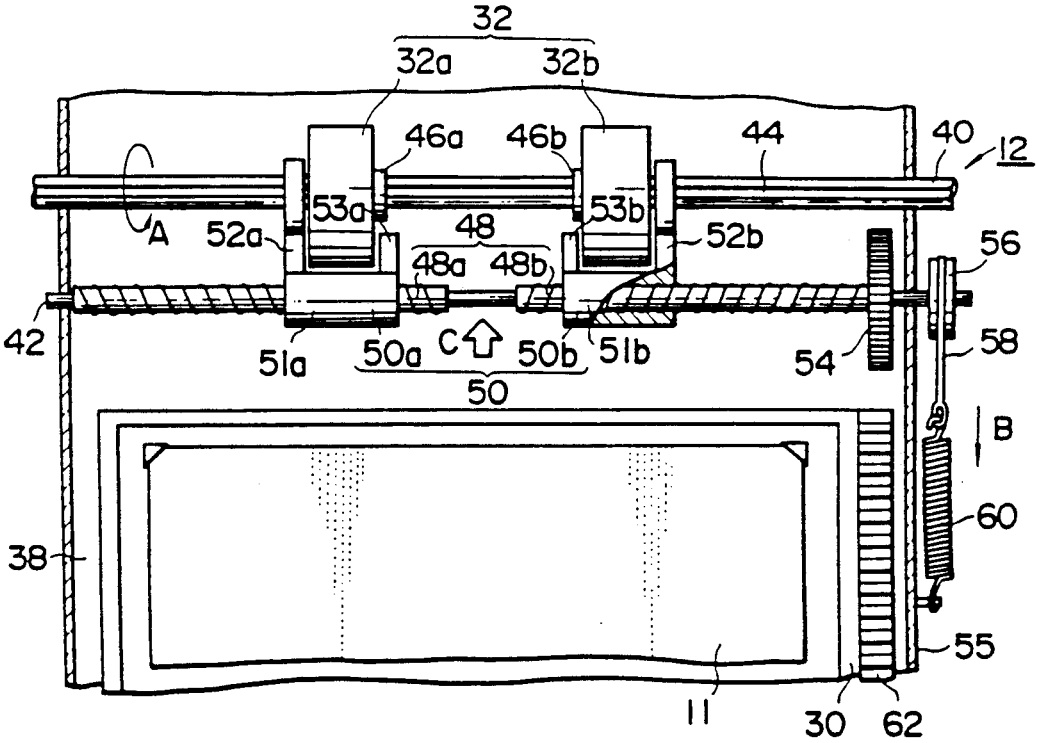
FIG. 2A through 2C are descriptive views showing sheet feeding device according to the present invention, wherein each of drawings respectively corresponding to sizes of sheet to be fed.

On the other hand, as shown in FIG. 2A, on one side of the sheet cassette 30, a cassette engagement section 62 which is engaged with the gear 54 is formed along the attaching direction (direction of an arrow mark C). The cassette engagement section 62 is a rack which is engaged with the gear 54. The size in the engagement direction depends on the size of the sheet 11 stored in the sheet cassette 30. In other words, the sheet cassettes 30, 130, and 230 shown in FIG. 2A through 2C respectively store the B4 paper 11, A4 paper 111, and B5 paper 211. Each size of the cassette engagement sections 62 and 162 is decreased as each size of the papers 11, and 111 is decreased. The sheet cassette 230 which is used for the B5 paper 211 is not provided with the cassette engagement section. In other words, each size of the cassette engagement sections 62 and 162 has been set so that the sheet feeding roller 32*a*, 32*b* are moved to a suitable position. In the case of this embodiment, the sheet feeding rollers 32*a*, 32*b* are constituted to be respectively positioned at one inch from the both side edges of the sheet to be fed.

An operation of the sheet feeding device 12 in the structure explained above is described hereinafter.

Figure 5:
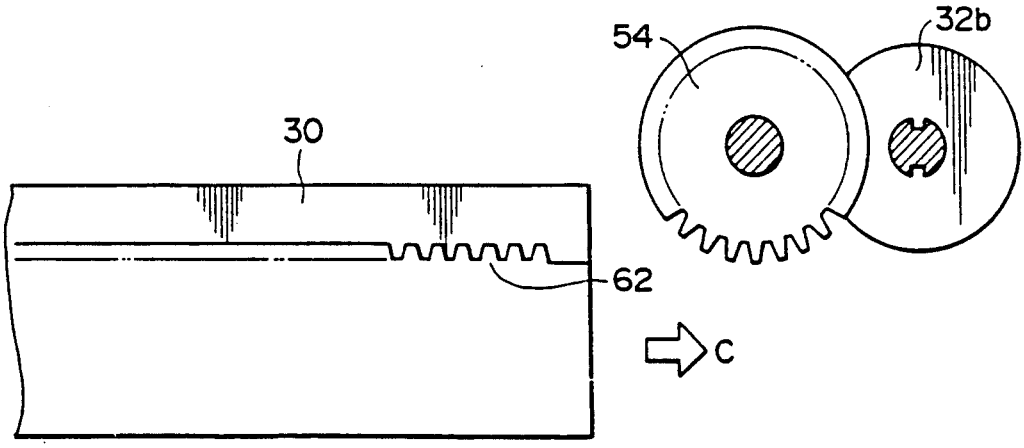
FIG. 5 is a descriptive view showing a structure of a gear which is provided on the sheet feeding device according to the present invention.

For example, when the B4 paper feed cassette 30 shown in FIG. 2A is attached to the machine main unit, the sheet cassette 30 is inserted in the direction of the arrow mark C. As the sheet cassette 30 is inserted, the cassette engagement section 62 is also moved as shown in FIG. 5, thereby engaging the cassette engagement section 62 with the gear 54 and rotating the gear 54 for the predetermined amount according to the size of the cassette engagement section 62. As the gear 54 is rotated, the guide screw section 48 is also rotated and thereby the roller movement section 50 which is engaged with the guide screw section 48 is outwardly moved for the predetermined amount corresponding to the amount of the rotation of the gear 54 and stopped at the predetermined position described above. When the sheet cassette 30 is fully inserted, the sheet feeding rollers 32*a*, 32*b* are lowered by the lift-down mechanism described above and contacted with the surface of the sheet 11, whereby the sheet can be fed. In other words, when the sheet feeding roller 32*a*, 32*b* are moved along the axial direction of the shaft 40, the paper 11 never wrinkles.

On the other hand, when the paper feed cassette 30 is detached, since the gear 54 is rotated in the reverse direction of the attachment operation, both the roller movement sections 50 are inwardly moved and both of the sheet feeding rollers 32*a*, 32*b* are placed in the initial positions. The guide shaft 42 is tensioned by the spring 60 in the direction of an arrow mark B shown in FIG. 4. Thus, when the sheet cassette 30 is not attached, the sheet feeding rollers 32*a*, 32*b* are respectively always moved to the initial position.

Figure 2B:
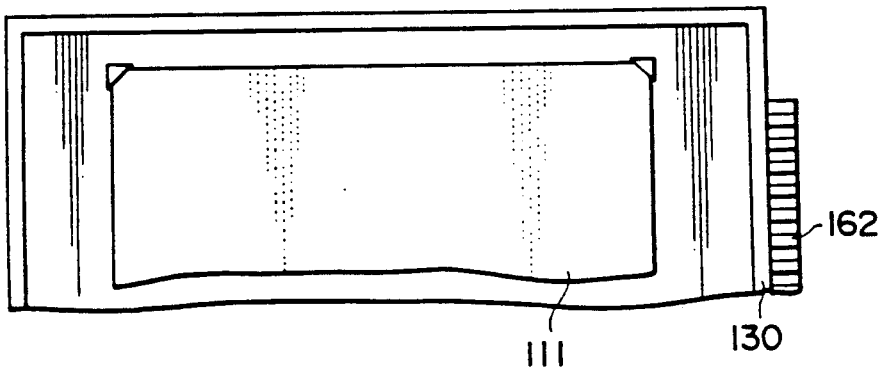
Figure 2C:
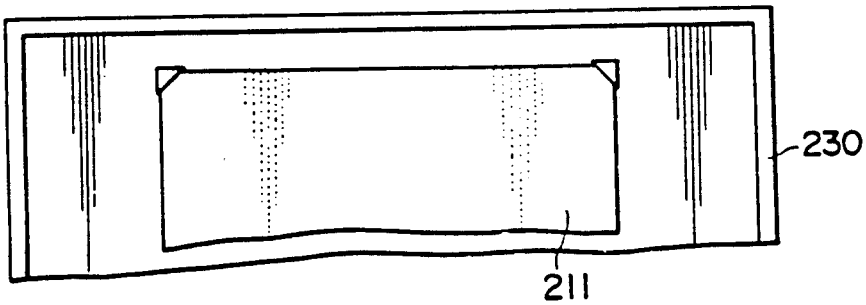
Figure 2D:
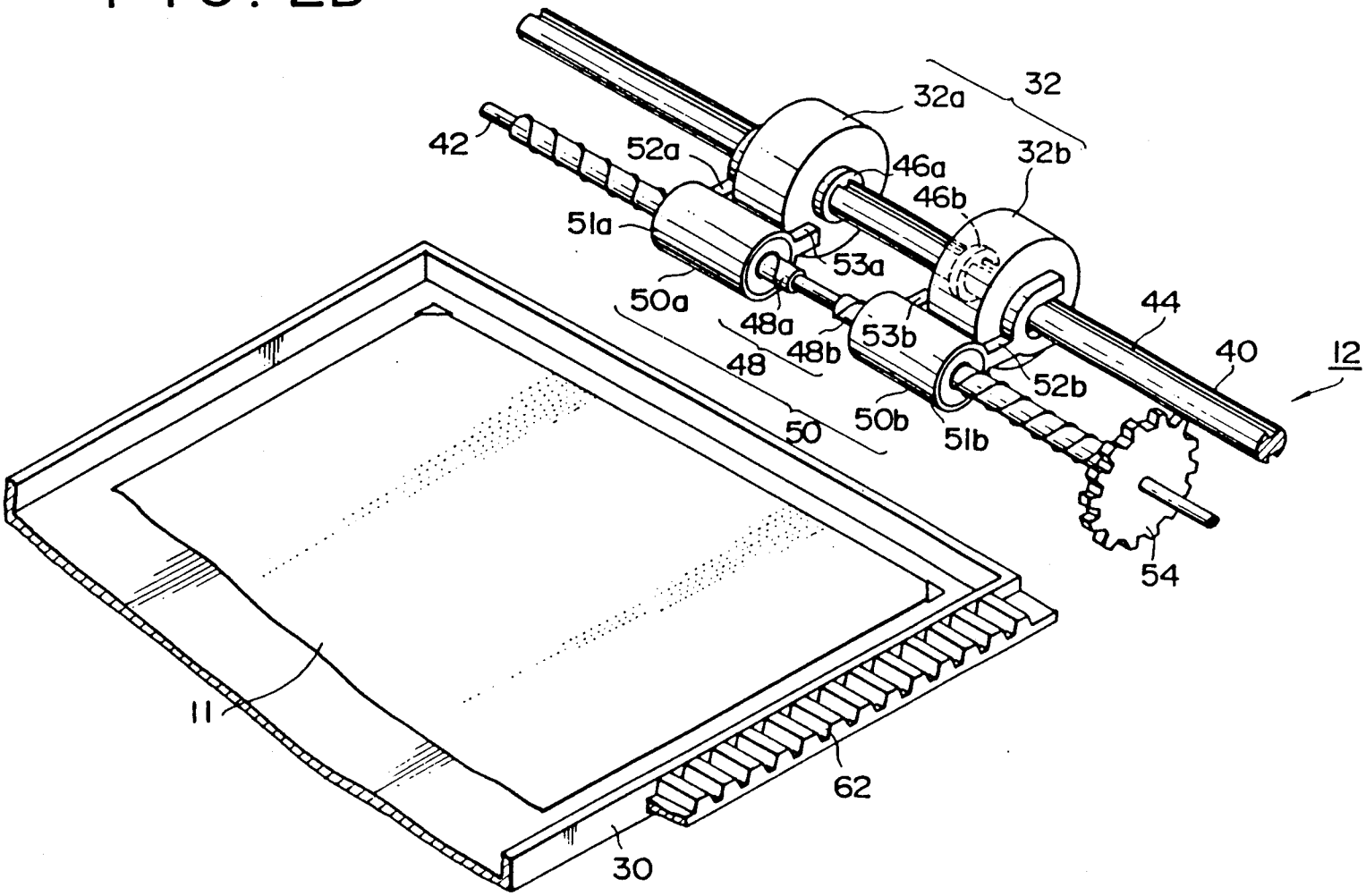
FIG. 2D is a perspective view showing the sheet feeding device of FIG. 2A.
Figure 3:
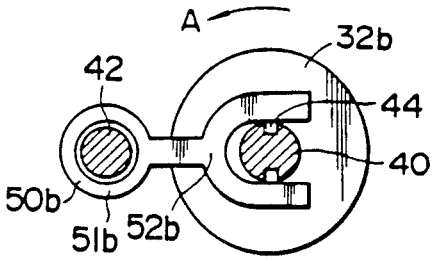
FIG. 3 is a sectional view showing a structure of a roller movement section provided on the sheet feeding device according to the present invention.

As shown in FIG. 2B, when the A4 sheet cassette 132 is used, it works like the above operation. However, since the size of the cassette engagement section 162 is shorter than that corresponding to the B4 sheet cassette 30, the amount of rotation of the gear 54 which is engaged with the cassette engagement section 162 is small. The sheet feeding roller 32*a*, 32*b* are respectively moved outwardly for the predetermined amount corresponding to the A4 sheet 111.

When the B5 sheet feed cassette 230 is attached, since it does not have the cassette engagement section, the roller movement section 50 and the sheet feeding rollers 32*a*, 32*b* do not move. In other words, the initial positions of the sheet feeding rollers accord with the B5 sheet 211.

As described above, in the sheet feeding device 12 according to this embodiment, since the sheet cassette 30 where the external size is nearly same and the size of the cassette engagement section varies according to the size of sheet to be stacked in the sheet cassette 30, when the sheet cassette 30 is attached to the copying machine main unit 1, the sheet feeding rollers 32*a*, 32*b* are moved according to the size of the sheet and placed at the most suitable positions for the sheet feeding operation. Thus, even if various sizes of sheets are used, they can be smoothly fed to the copying machine main unit 1. In addition, since the sheet feeding rollers 32*a*, 32*b* are moved in the structure that the rotation force of the gear 54 is converted into the horizontal force using the guide screw section 48 and the roller movement section 50, the sheet feeding device 12 and the copying machine main unit 1 can be compactly structured and the sheet feeding rollers can be securely moved.

Although one embodiment of the present invention has been described above, the present invention is not limited only to the above embodiment. In the range of the gist of the present invention, it can be applied in various manners.

For example, it is possible to apply the present invention in the manner that while the sheet is arranged at one side edge, one of the sheet feeding rollers is fixed in a predetermined position and the other of rollers is moved. Moreover, it is possible to apply the present invention in the manner that another engagement structure using rollers which is constituted so as not to smoothly rotate, such as rubber rollers can be used rather than using a pinion and rack such as the cassette engagement section and the gear in this embodiment.

Furthermore, it is also possible to apply the present invention in the manner that a belt which is driven by a pulley and the like as the means for horizontally moving the roller movement section.

In the above embodiment, although the lift-down unit for vertically moving the shaft and the sheet feeding rollers has been provided, it is also possible to apply the present invention in the manner that the cassette engagement with more distance than the above embodiment so that the position adjustment of the sheet feeding rollers are completed before the sheet feeding rollers are contacted with the sheet stored in the sheet cassettes without providing the lift down mechanism. In addition, it is also possible to apply the present invention to an ink-jet printer, laser printer, and the like.

What is claimed is:

1. A sheet feeding device comprising:

a case member for holding a plurality of sheets therein in a stacked state;

a pair of feed roller members coaxially mounted on a shaft member for feeding said sheets in a feed direction one by one from said case member, said shaft member extending perpendicular to the sheet feed direction, said roller members being slidable along said shaft member whereby the interval between said roller members is variable;

a rack portion provided on said case member extending in said sheet feed direction, the length of said rack portion representing the type of sheet to be held in said case member; and means for changing the interval between said pair of feed roller members depending upon the length of said indicator, said interval change means comprising another shaft extending parallel to the said shaft member and a pinion secured to said another shaft to engage said rack in such a fashion that the length of said rack portion is converted to degrees of rotation of said another shaft via said pinion when said pinion is brought into engagement with and rotated by said rack portion, said interval between said rollers being changed by the amount of rotation of said another shaft.

2. The sheet feeding device according to claim 1, wherein said another shaft member is biased to rotate in one direction to be put at its original state as well as to prevent rotation thereof in another direction, said rack portion rotating said pinion member in said another direction against said biasing force, whereby said another shaft member is rotated to restore its original state every time when said rack portion is disengaged from said pinion member.

3. The sheet feeding device according to claim 2, wherein said interval change means further comprises a pair of guide members coupled to said feed roller members, respectively, so as to be moved integrally with respective feed roller members; wherein said another shaft member is provided with a pair of screw portions formed on the circumferential surface thereof, screwed directions of said pair of screw portions being opposite to each other, said pair of guide members being threadably mounted on said pair of screw portions, respectively, so that said pair of guide members approach to each other by rotation of said another shaft member, approaching amount of said guide members being determined dependent upon said amount of rotation of the another shaft member.

4. The sheet feeding device according to claim 3, wherein each of said pair of guide members comprises a cylindrical base portion threadably mounted on said another shaft member and a yoke portion extended from said cylindrical base portion for coupling the corresponding feed roller member thereto and for transmitting the movement of said cylindrical base portion to said corresponding feed roller member.

* * * * *